US005924644A

United States Patent [19]

Feiler et al.

[11] Patent Number: 5,924,644

[45] Date of Patent: Jul. 20, 1999

[54] METHOD OF PRODUCING DIFFERENT TYPES OF SPOOL WINDINGS, ESPECIALLY FLYER OR COMPOSITE SPOOLS

[75] Inventors: Horst Feiler, Göppingen; Hermann Gúttler, Uhingen; Ralf Wilhelmstätter, Kuchen, all of Germany

[73] Assignee: Zinser Textilmaschinen GmbH, Ebersbach/Fils, Germany

[21] Appl. No.: 09/052,729

[22] Filed: Mar. 31, 1998

[30] Foreign Application Priority Data

Apr. 4, 1997 [DE] Germany ..... 197 13 959

[51] Int. Cl.[6] ..... B65H 18/08

[52] U.S. Cl. ..... 242/476.8; 242/478.3; 242/478.6; 242/479; 242/479.1

[58] Field of Search ..... 242/476.8, 478.6, 242/478.3, 479, 479.1, 479.6

[56] References Cited

U.S. PATENT DOCUMENTS

| | | | |
|---|---|---|---|
| 865,048 | 9/1907 | Klein | 57/98 |
| 2,764,363 | 9/1956 | Stammwitz | 242/478.6 |
| 3,113,414 | 12/1963 | Negishi | 52/277 |
| 3,334,828 | 8/1967 | Harrison | 242/478.3 |
| 3,422,614 | 1/1969 | Durler et al. | 57/99 |
| 3,751,898 | 8/1973 | Inaba et al. | 57/156 |
| 3,835,636 | 9/1974 | Nakanishi et al. | 57/156 |
| 3,841,074 | 10/1974 | Wachendorf et al. | 57/34 TT |
| 4,316,357 | 2/1982 | Le Chatelier | 57/95 |
| 4,359,858 | 11/1982 | Wolf | 57/93 |

FOREIGN PATENT DOCUMENTS 41 15 186 11/1992 Germany .

*Primary Examiner*—Donald P. Walsh
*Assistant Examiner*—Minh-Chau Pham
*Attorney, Agent, or Firm*—Herbert Dubno

[57] ABSTRACT

A process for producing different types of windings, especially a flyer winding or a composite winding, in the formation of a spool on a core sleeve of a spindle in a draft-twisting machine or frame in which, instead of displacing the ring rail over the full height of the spool to be formed, the full height is subdivided into zones and the ring rail is reciprocated in each of these zones only through a fraction of the total structure of the ring rail. During the winding in each zone, the spindle speed is held approximately constant and the spindle speed is changed only upon a transition from one zone to another.

17 Claims, 5 Drawing Sheets

FIG.6
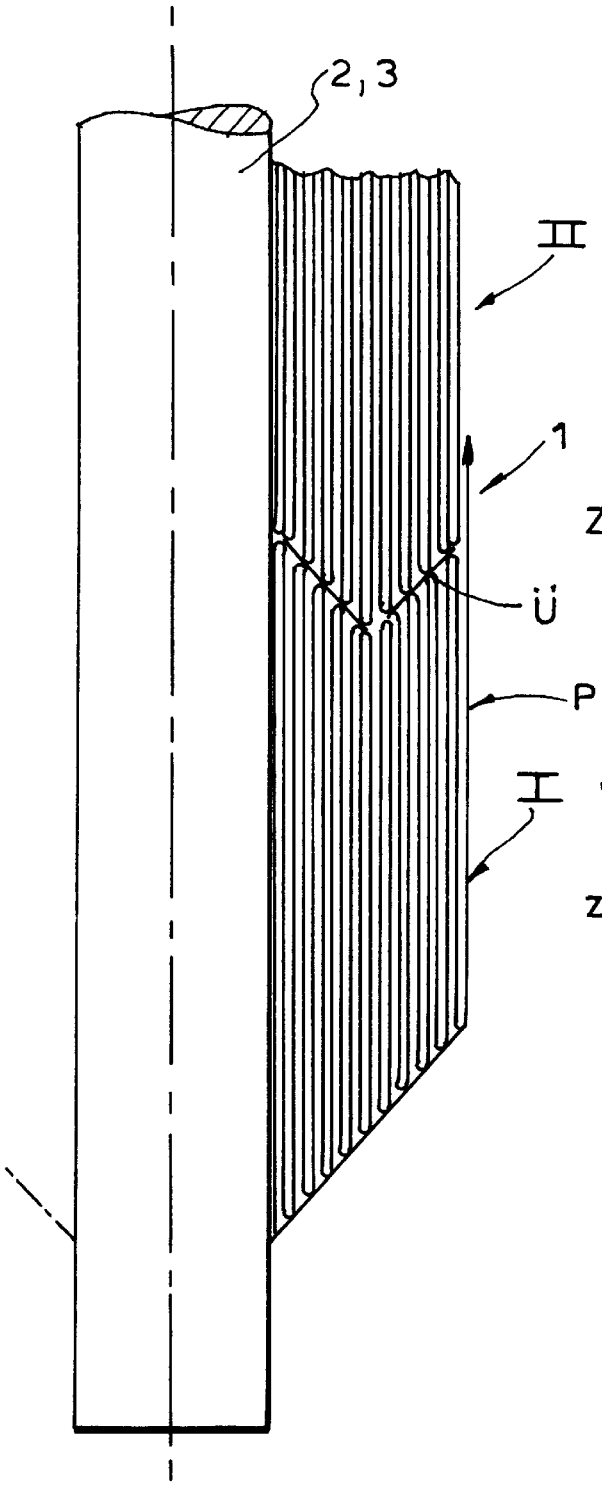
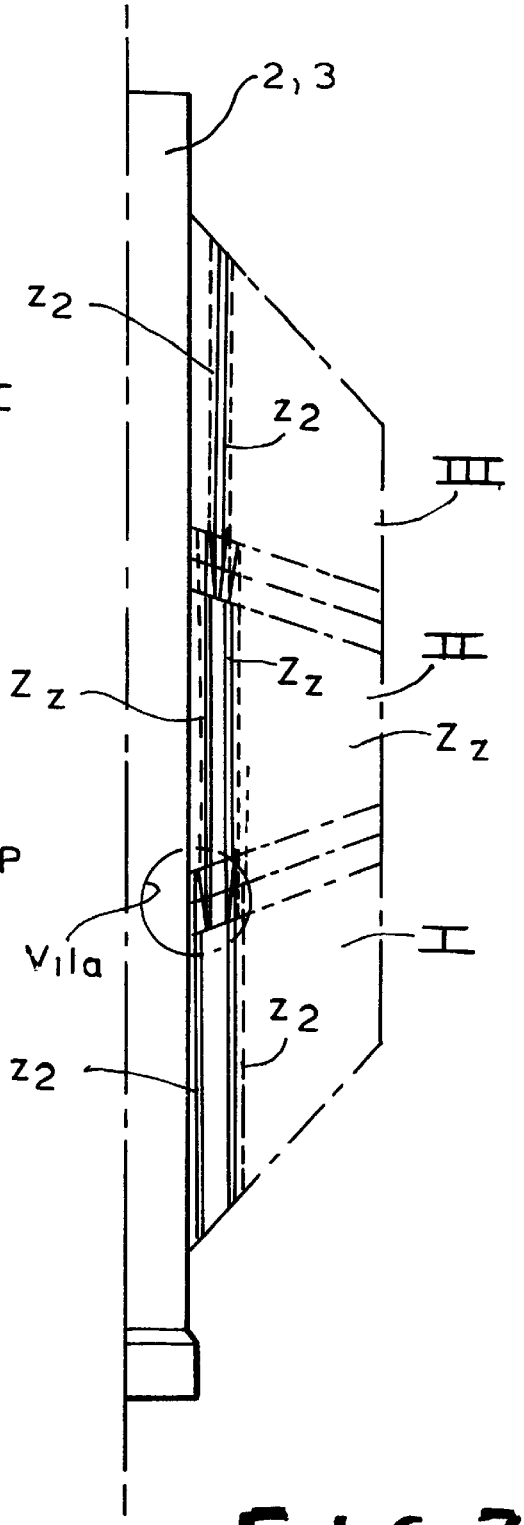
FIG.7

FIG. 8
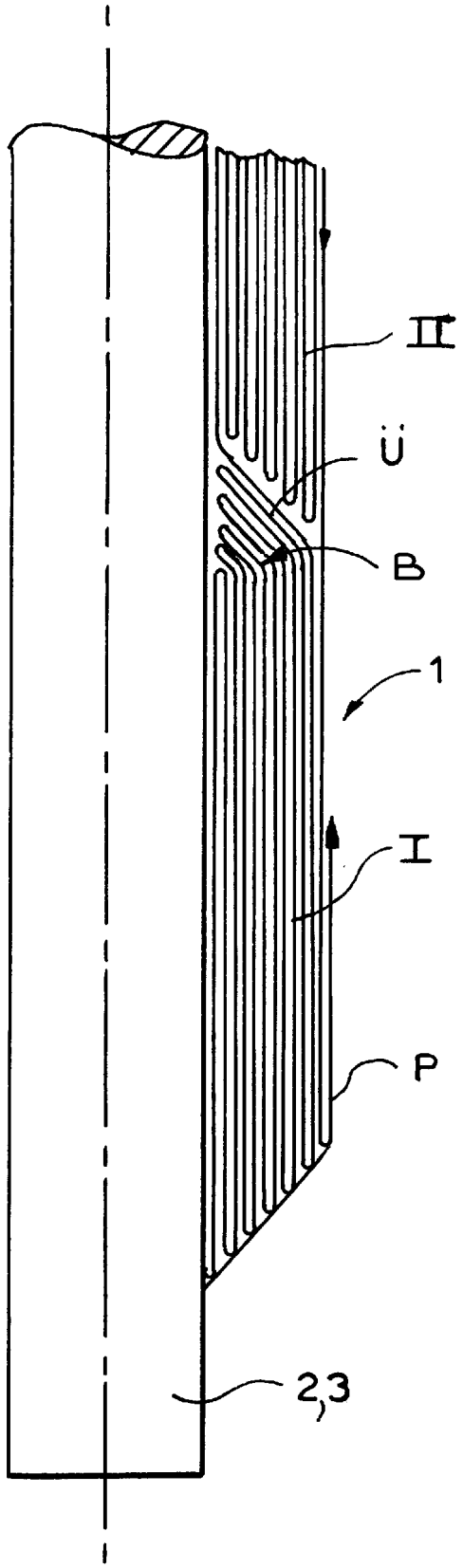
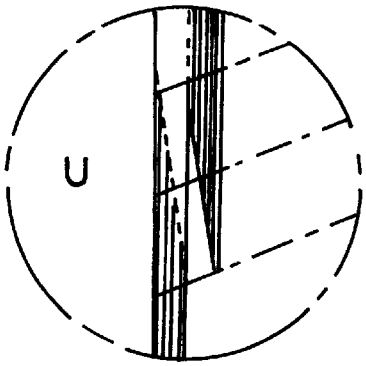
FIG. 7a

METHOD OF PRODUCING DIFFERENT TYPES OF SPOOL WINDINGS, ESPECIALLY FLYER OR COMPOSITE SPOOLS

FIELD OF THE INVENTION

Our present invention relates to a method of producing different types of windings, especially so-called flyer or composite windings in the formation of spools utilizing a spindle which can be driven at various speeds in a drafting or twisting machine whose ring rail can be controlled with respect to its lifting action.

BACKGROUND OF THE INVENTION

In the formation of spools of yarn upon a core sleeve, the latter may be mounted upon a spindle on a spindle rail accommodating a multiplicity of spindles in a twisting frame in which each spindle is surrounded by a ring along which a traveller orbits the spool as it is formed.

The yarn or thread to be wound up in the spool, usually coming from a drafting frame or the like, forms a balloon around the sleeve of spindle and passes through the traveller before reaching the spool that is formed on that sleeve.

In German patent document DE 41 15 186 C2, a process has been described for varying the speed of the spindles of such a twisting machine and, in that case, the speed of the spindles can be varied with respect to a basic speed during each lifting movement of the ring rail, i.e. the rail carrying the rings upon which the travellers orbit the respective spindles. In this case, moreover, the speed can be reduced with increasing distance between the supply unit and the traveller and ring arrangement, or increased with decreasing distance between the supply unit and the traveller/ring arrangement.

The supply unit can be a drafting frame or other source of the threads or yarns which are to be twisted together. The spindle speed thus varies as a function of the yarn balloon height which is a function of the ring rail position, usually to maintain the yarn tension in the yarn balloon at an approximately constant value during the entire twisting and spool formation operation.

In practice it is found that to maintain an approximately uniform thread tension in the yarn balloon, in the formation of a so-called flyer winding, where the winding layers are substantially parallel to one another, or a so-called composite winding in which, over the major part of the spool, the layers are parallel but at the ends of the spool, conical winding layers are provided, the spindle speed must be repeatedly raised and lowered as a ring rail rises and falls. This has been found to require a large energy consumption for the acceleration and deceleration of the spindles and to significantly stress the spindle drive with drawbacks with respect to maintenance and the like.

OBJECTS OF THE INVENTION

It is the principal object of the present invention, therefore, to provide a method for producing various spool types on a twisting frame whereby the energy consumption can be reduced, the useful life of the spindle drive increased and drawbacks of the earlier system avoided.

Another object of the invention is to provide an improved method of operating a twisting frame for the purposes described which can simplify the drive requirement for the spindle and ring rail mechanisms.

SUMMARY OF THE INVENTION

These objects and others which will become apparent hereinafter are attained, in accordance with the invention by subdividing the overall height displacement of the ring rail into at least two twisting regions corresponding to at least two height regions with the ring rail being displaced up and down within the more limited region before it is moved into the next more limited region for movement up and down therein whereby the spindle speed can be held substantially constant while the ring rail is moved up and down in each of the regions, with a speed change for the spindle being effected substantially only upon a change in the range of the ring rail from one section to another.

According to the invention, with the total displacement of the ring rail subdivided into at least two and preferably three adjoining regions in which the ring rail undergoes multiple vertical reciprocation in each region before it is shifted into the adjacent region, the number of changes in speed of the spindle can be reduced to a minimum.

Since the machine tends to operate for relatively long intervals in each of the regions before the ring rail is shifted to operation in another region, the spindle speed can be optimized for each of the relatively long intervals. As a consequence with reduced overall energy consumption there is an improvement in the quality of the twisted yarn and in the quality of the spools which are produced.

In the case of flyer windings with parallel winding layers, it is possible to optimize the spindle speed to match the bobbin diameter or, where advantageous, to match the spindle speed to the bobbin diameter. This too has been found to improve the yarn travel onto the bobbin and the quality of the product which results.

Another advantage of the present invention is that a system for detecting the transition points between the height zones can be provided which is less sensitive or delicate than a system for continuously varying the spindle speed, to switch over the spindle speed from that which is appropriate for one zone to that which is appropriate for another zone.

This allows the variable formation of edge roundings. With such edge roundings, the spools can have improved transport stability and a higher degree of fullness of the bobbins even in the case of more stumpy inclinations at the ends of the bobbin, i.e. the realization of higher bobbin weights for a given bobbin diameter.

In each of the discrete regions of the winding of the more limited stroke of the ring rail for each region, the height of the yarn bobbin varies so little so that a change in the spindle speed can be largely suppressed in spite of the change of height of the ring rail. The spindle speed thus remains uniform during each limited vertical stroke of the ring rail for the individual winding region and is changed only upon the transition of the ring rail into another portion, i.e. the neighboring stroke range. For this purpose the spindles can be accelerated or decelerated. Since the acceleration and deceleration of the spindle speed is limited to a single up or down movement of the ring rail from one winding region into to an adjoining winding region, the reduction or increase in the speed can be relatively limited and can be proportional to the number of strokes in the corresponding region. The accelerations and decelerations can be limited to between 3 and 20 for a winding of the spool in practice.

It has been found to be advantageous to wind each of the regions with approximately the same winding heights. It can be advantageous to effect the winding in each region for a limited portion of the total winding height, to then effect a transition to an adjoining region for a similar limited portion of the total winding height, and then effect a transition to the thread regions, again for the same limited portion of the winding height, before repeating the process for another portion of the overall winding height. In practice the portion of the winding height wound in each stage is about one-third. When the overall winding height is reduced, for example in the case of a flyer type of parallel winding, then the portion of the winding height wound at each stage can be correspondingly reduced.

To avoid noticeable junctions between the plurality of individually wound zones on the spool or bobbin or regions in which transition would be noticeable because of an overlap or a gap between the junctions, it has been found to be advantageous to stagger windings at the junctions of the zones so that the winding layer in one zone may be set back while the winding layer of an adjacent zone reaches toward that layer. This staggering of the layers can be achieved by varying the stroke in the respective zones or by maintaining a constant stroke and simply shifting the location at which the direction change of the ring rail takes place.

BRIEF DESCRIPTION OF THE DRAWING

The above and other objects, features, and advantages will become more readily apparent from the following description, reference being made to the accompanying drawing in which:

FIG. 6 illustrates the application of the winding system of the invention of a purely parallel winding of a spool;

FIG. 7 is a diagram illustrating schematically the offsetting of the layers and hence the upper and lower direction change points;

FIG. 7*a* is a detail view of the region VIIa of FIG. 7;

FIG. 8 is a view similar to FIGS. 6 and 7 showing another way of forming a parallel wound spool according to the invention.

SPECIFIC DESCRIPTION

Figure 9:
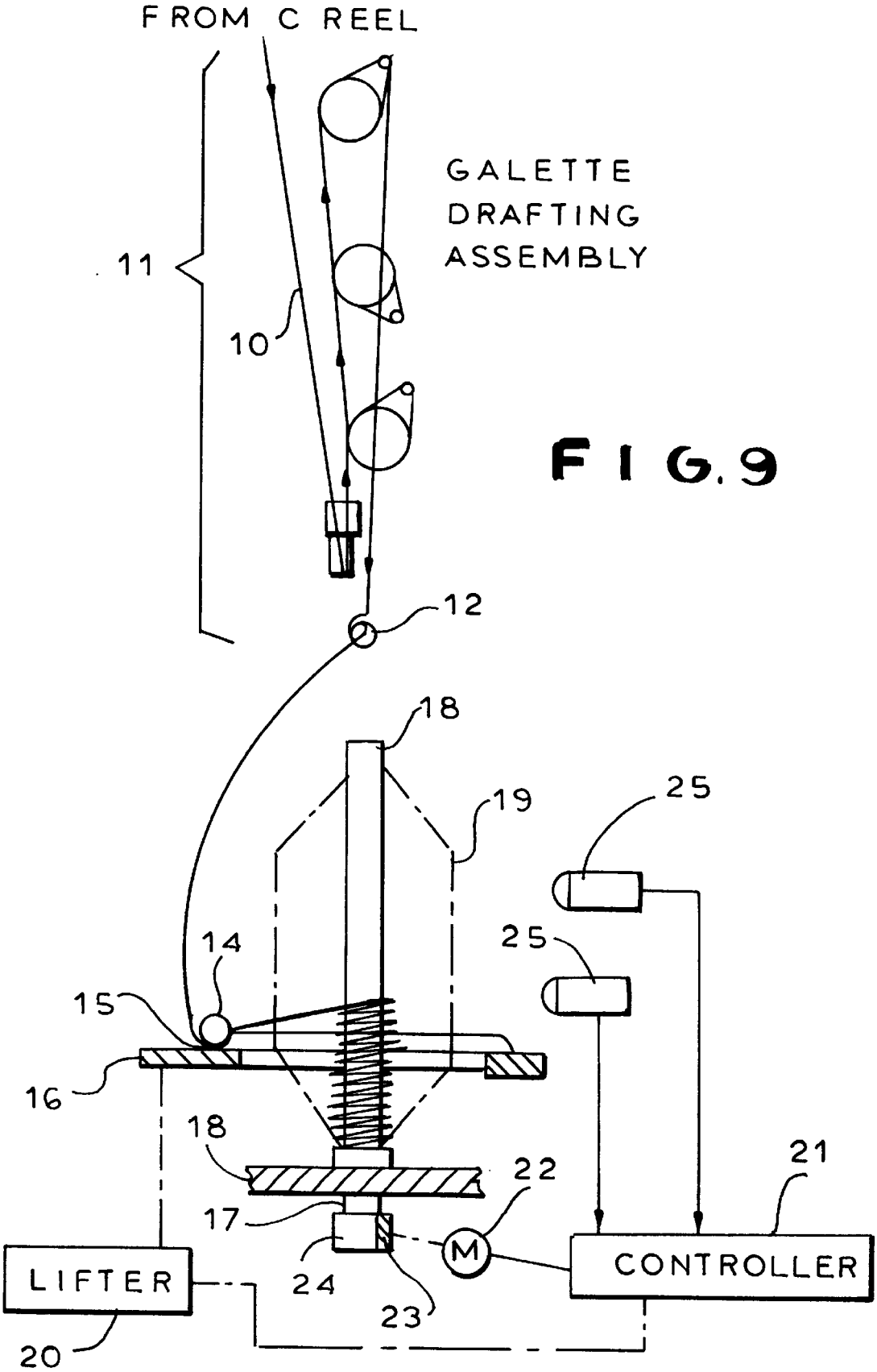
FIG. 9 is a diagram illustrating an apparatus for carrying out the method of the invention in a highly simplified form.

Referring first to FIG. 9, it can be seen that a twisting machine to which a yarn 10 is fed which can comprise two or more threads can comprise the drafting frame 11 and a thread-guide eye 12 from which the yarn 10 passes in a balloon 13 to a traveller 14 of a ring 15 of a ring rail 16.

In the usual twisting frame, a large number of spindles 17 are provided on a spindle rail 18 on each side of the machine and each spindle receives two or more threads which are twisted and deposited on a core sleeve 18 of the respective spindles to form a spool 19 which, in FIG. 9, has been shown to be of the conical-end type.

The rail 18 is vertically displaceable by a lifter 20 operated by a controller 21 which also operates a drive motor 22 for the belt 23 which engages the whorls 24 of the spindles. Means such as the sensors 25 can be provided to detect the position of the ring rail 18 to provide input to the controller 21 which may be programmed to produce the particular winding patterns described.

In a prior art approach to the winding of a spool on the core sleeve 2, the ring rail 18 is displaced the full height of the winding which is to cover the core sleeve and hence the major part of the height of the bobbin or spool. By contrast, with the system of the invention the height of the spool is subdivided vertically into the zones I, II and III in the manner to be described below.

Figure 1:
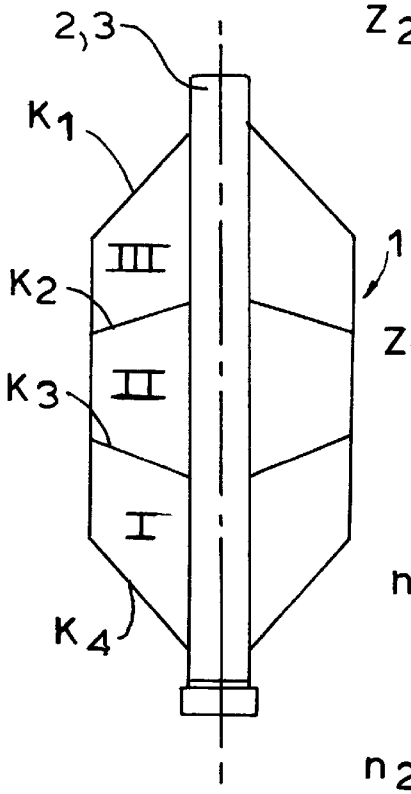
FIG. 1 is a schematic cross sectional view through a wound spool showing three winding regions or zones in side view.

More specifically, FIG. 1 shows a section through a flyer-type winding of a spool, or a composite winding represented at 1 which is wound upon a core sleeve 2 on a spindle 3 and can form part of a working station of a draft-twisting machine whose ring rail can be vertically reciprocated as has been described in connection with FIG. 9.

As can be seen from FIG. 1, the total stroke of the ring rail is subdivided into which correspond to windings zones I, II and III. Before the ring rail is displaced into a further zone, for example, the zone for winding II or the zone for winding III, it is vertically reciprocated in the prior zones for windings I or II for a multiplicity of times, i.e. with multiple strokes, while the spindle speed in each of these zones is held approximately constant and is only varied upon the transition to the next, preferably a neighboring zone.

For the spool 1, for each of the three winding regions I, II and III have been shown in all three zones, the ends are conical with respective cones, $K_2$, $K_3$, $K_3$, $K_4$. In other words in the embodiment described, conical regions $K_1$ and $K_2$ are provided at the transitions between region I and the region II and between the region II and the region III, respectively. Alternatively, the ends of the region II can be planar and perpendicular to the axis of the spindle.

Figure 2:
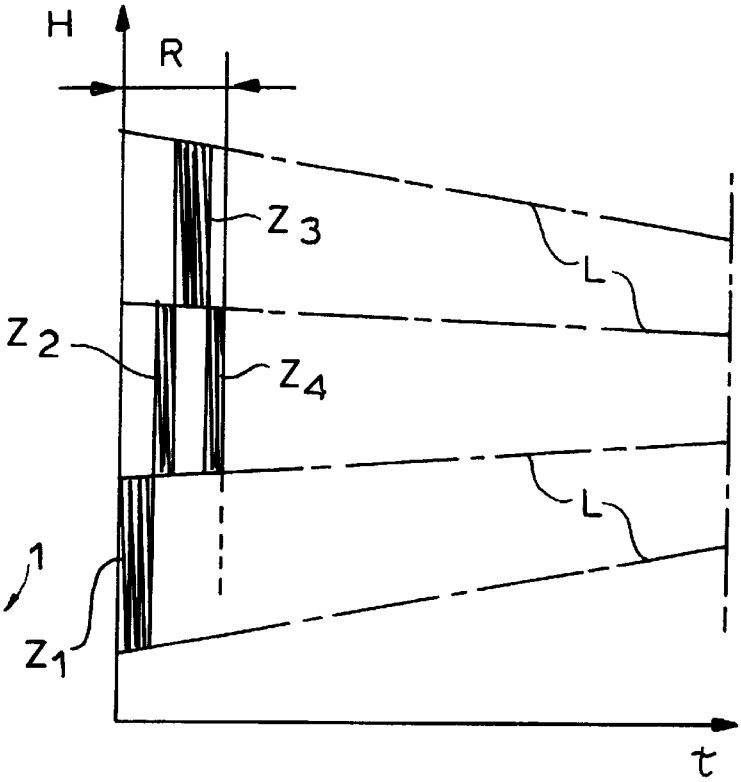
FIG. 2 is a diagram in which the height of the ring rail is plotted against time, illustrating the principles of the invention for the formation of the bobbin or spool of FIG. 1.

FIG. 2 is a stroke versus time diagram for the winding of the spool of FIG. 1. Time is plotted along the abscissa while the stroke in vertical displacement is plotted along the ordinate H. In the winding region I, winding layers have been produced by up and down displacement of the rail ring with a stroke 2, of about one-third of the total height of the intended spool. In the region II, two sets of windings can have been formed during the time interval R by the strokes $Z_2$ and $Z_3$. In the zone III the windings have been formed by strokes $Z_3$, the windings having approximately equal lengths as measured parallel to the axis. As also will be apparent from FIG. 2, while the regions at I and III have $z_1$, and $Z_3$ layers each of n layers, the windings $z_2$ and $z_4$ each correspond to n/2 layers. The winding pattern to the time R representing one repetition cycle is thus n, n/2, n, n/2 turns for the transitions from zone I to zone II, zone II to zone III and zone III to zone II.

Figure 3:
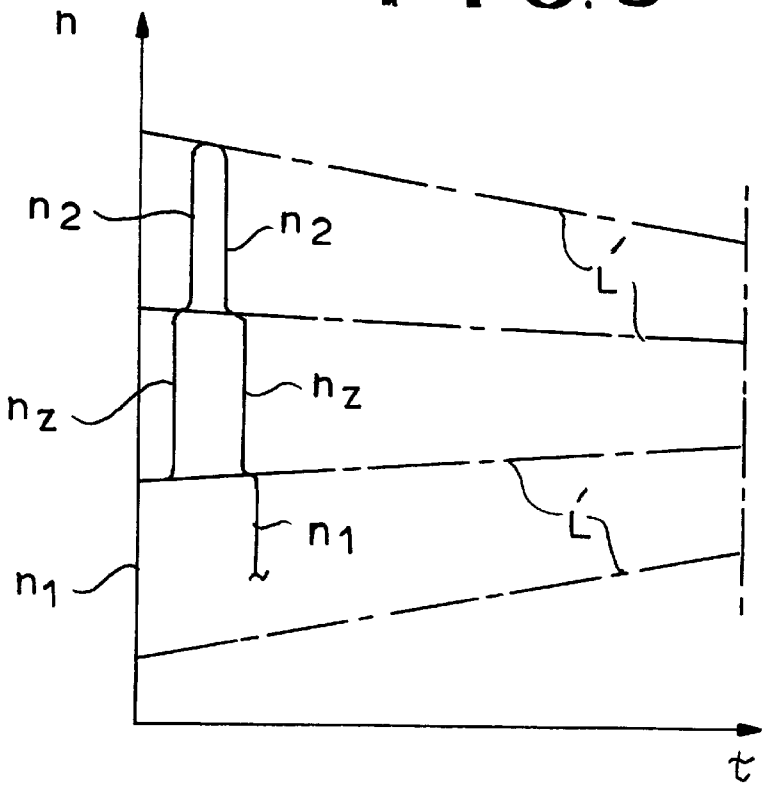
FIG. 3 is a diagram of the spindle speed versus time for the ring rial action illustrated in FIG. 2.

As can be seen from FIG. 3, the spindle speed n is varied from an original speed $n_1$ to the greater speed $n_z$ and then to the still greater speed $n_2$ before passing through the speed range $n_z$ back to speed $n_1$ during the same cycle. In the region III, the spindle speed is therefore the highest.

As can be seen from FIG. 3, during each winding stage at a particular zone I, II and III, the speed $n_1$–$n_z$ remains of a given level and is changed only upon the transition from the zone I to the zone II and from zone II to the zone III.

Since the mean yarn balloon height in the region I decreases with increasing development of the spool and increases in the region III, as can be seen from the dot-dash lines L and L' in FIG. 3, there is a corresponding change in the speeds with time.

Figure 4:
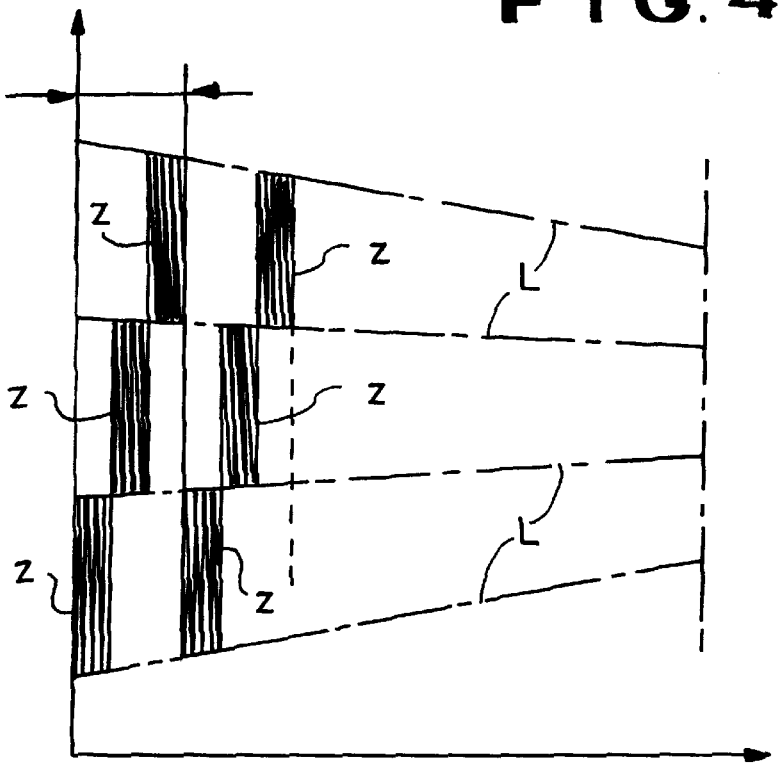
FIG. 4 is a height versus time diagram illustrating another winding approach utilizing the principles of this invention.
Figure 5:
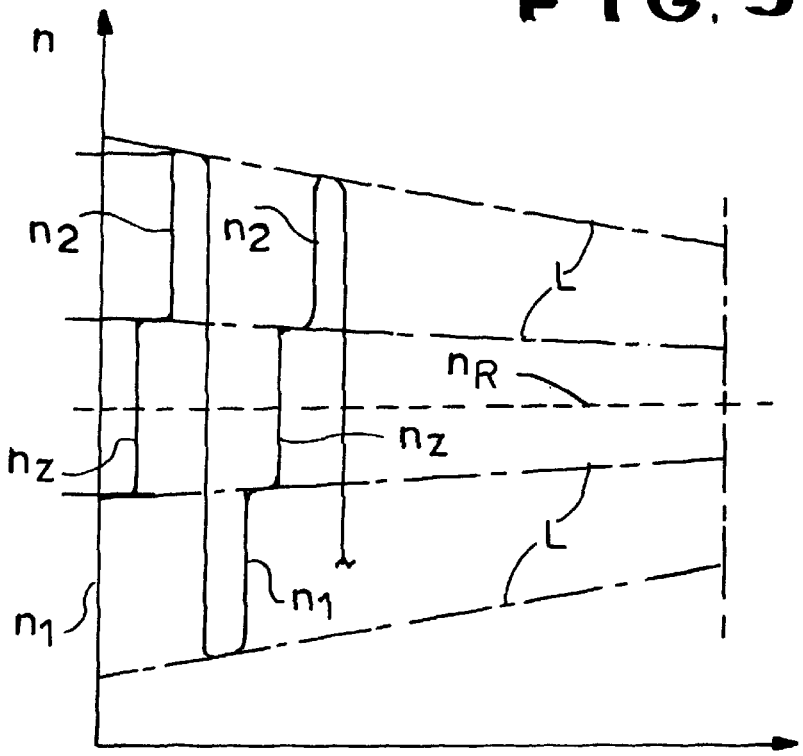
FIG. 5 is a spindle speed versus time diagram for the system of FIG. 4.

FIGS. 4 and 5 show another embodiment of the invention generally analogous to that of FIGS. 2 and 3. In this case z windings are provided in each of the regions I, II and III during each phase of the cycle so that even in one cycle, three winding sections of equal points are formed. The number of winding layers is the same in all three regions. From FIG. 5, therefore, it will be apparent that the speed changes through the sequence $n_1$, $n_z$, $n_2$ before falling back to the speed $n_1$ from cycle to cycle. A mean speed is represented at $n_R$.

FIG. 6 shows the formation of a type of winding that can be considered to be a purely parallel winding. Here only the regions I and II have been shown with overlapping occurring in the zones Ü between the successive zones.

FIGS. 7 and 7*a* show the offsetting of the upper and lower points of reversal of the ring rail in a type of winding similar to that of FIG. 2. The reversal points U or Ü delimit the winding regions I, II and III and, for example, as the reversal regions progressively recede in a lower region, they extend downwardly in an upper region.

FIG. 8 shows that, in a boundary region B between two zones I and II, composite winding layers can be formed with overlapping portions of a lower winding, as shown at Ü being deflected inwardly. Subsequent windings can be purely parallel as has been indicated at P for example. These windings may extend across two or more zones I, II, etc. The spacing between the offset reversing points in the regions I and II can be equal. Because the overlapping of the lower reversing points of the ring rail movement at the frustoconical end of the spool, even at the frustoconical end, a composite type winding can be formed.

We claim:

1. A method of producing different types of windings of a spool formed on a core in a drafting-twisting machine in which the core is mounted on a spindle and yarn is wound on the core from travellers orbiting on respective rings of a vertically displaceable ring rail, comprising the steps of:

a) subdividing a total height of displacement of said ring rail, corresponding to the movement of said ring rail vertically to form the entire length of said spool on said core into at least two winding zones;

b) maintaining a substantially constant speed of said spindle for winding yarn on said core in each of said zones while vertically reciprocating said ring rail over only a portion of said layer for winding yarn on said core in each of said zones; and c) changing said speed of said spindle from a first speed with which said yarn is wound in said spool in one of said zones to a second speed with which said yarn is wound in said spool in a second of said zones.

2. The method defined in claim 1 wherein said zones are adjacent one another.

3. The method defined in claim 1 wherein the ring rail is displaced through a stroke during winding in each of said zones which is a fraction of an overall displacement of said ring rail for winding said spool over said length.

4. The method defined in claim 3 wherein the stroke of said ring rail for winding in each of said zones is substantially equal.

5. The method defined in claim 4 wherein, for flyer types or composite winding of said spool, at transitions between neighboring zones, ends of said windings are offset from one another.

6. The method defined in claim 5 wherein portions of said windings of said zones overlap.

7. The method defined in claim 1, further comprising the step of varying a stroke of said ring rail for winding in each of said zones.

8. The method defined in claim 1, further comprising the step of imparting a conical shape to a lower end of a lower one of said zones and a conical shape to an upper end of an upper one of said zones.

9. The method defined in claim 8, further comprising the step of forming a junction perpendicular to an axis of said spool between two adjoining zones.

10. The method defined in claim 8, further comprising the step of forming a conical junction between two adjacent zones.

11. The method defined in claim 8, further comprising the step of forming on at least one of said zones a combination of conical and horizontal base and top regions.

12. The method defined in claim 1 wherein three mutually adjacent winding zones are formed in a flyer or composite spool.

13. The method defined in claim 12 wherein said zones include a lower zone of n winding layers, an intermediate zone of n/2 winding layers and an upper zone of n winding layers followed by another intermediate winding of n/2 winding layers in a sequence.

14. The method defined in claim 12 wherein all three winding zones are formed with n winding layers one after another in a sequence before repetition of that sequence.

15. The method defined in claim 12 wherein all three winding zones are formed in succession with n/2 winding layers and said ring rail is returned to a starting point before repetition of the sequence.

16. The method defined in claim 1, further comprising winding at least one parallel layer of said yarn over a plurality of said zones.

17. The method defined in claim 1, further comprising the step of forming parallel windings in at least one of said zones over overlapping winding regions of an adjacent zone.

* * * * *